US009121679B1

(12) United States Patent
Kim et al.

(10) Patent No.: US 9,121,679 B1
(45) Date of Patent: Sep. 1, 2015

(54) LIMITED RANGE PROJECTILE

(71) Applicants: Brian Kim, Fort Lee, NJ (US); Mark Minisi, Stanhope, NJ (US); Stephen McFarlane, Bethlehem, PA (US)

(72) Inventors: Brian Kim, Fort Lee, NJ (US); Mark Minisi, Stanhope, NJ (US); Stephen McFarlane, Bethlehem, PA (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 69 days.

(21) Appl. No.: 13/888,649

(22) Filed: May 7, 2013

(51) Int. Cl.

| | |
|---|---|
| ***F42B 10/48*** | (2006.01) |
| ***F42B 12/06*** | (2006.01) |
| *F42B 10/00* | (2006.01) |
| *F42B 12/00* | (2006.01) |

(52) U.S. Cl.
CPC ..... *F42B 10/48* (2013.01); *F42B 12/06* (2013.01)

(58) Field of Classification Search
CPC ..... F42B 10/32; F42B 10/48; F42B 12/02; F42B 12/04; F42B 12/06; F42B 12/34; F42B 12/72; F42B 12/74; F42B 12/76
USPC ..... 244/3.1; 89/1.11, 1.1; 102/335, 336, 102/345, 347, 352, 360, 382, 394, 396, 397, 102/501, 514, 516–517, 507–510
See application file for complete search history.

(56) References Cited

U.S. PATENT DOCUMENTS

| | | | | | |
|---|---|---|---|---|---|
| 2,436,378 | A | * | 2/1948 | Chenoweth | 102/516 |
| 3,063,376 | A | * | 11/1962 | Powell | 102/517 |
| 3,412,681 | A | * | 11/1968 | Hans-Ludwig Schirneker | 244/3.1 |
| 3,754,507 | A | * | 8/1973 | Dillinger et al. | 102/518 |
| 4,222,330 | A | * | 9/1980 | Krystyniak | 102/501 |
| 4,726,543 | A | * | 2/1988 | Stessen | 244/3.1 |
| 5,368,255 | A | * | 11/1994 | August | 244/3.1 |
| 5,567,908 | A | * | 10/1996 | McCubbin et al. | 102/519 |
| 5,939,662 | A | * | 8/1999 | Bootes et al. | 102/517 |
| 6,186,072 | B1 | * | 2/2001 | Hickerson et al. | 102/518 |
| 6,276,277 | B1 | * | 8/2001 | Schmacker | 102/518 |
| 7,741,588 | B2 | * | 6/2010 | Gundel et al. | 244/3.1 |
| 8,122,833 | B2 | * | 2/2012 | Nielson et al. | 102/517 |

* cited by examiner

*Primary Examiner* — Bernarr Gregory
(74) *Attorney, Agent, or Firm* — Henry S. Goldfine

(57) ABSTRACT

A limited range projectile includes pyrotechnic material and reactive material. The pyrotechnic material is ignited at projectile launch. The pyrotechnic material ignites the reactive material. If the projectile reaches a maximum desired range prior to impact with a target, the ignited reactive material transforms the projectile into an aerodynamically unstable object.

13 Claims, 3 Drawing Sheets

LIMITED RANGE PROJECTILE

STATEMENT OF GOVERNMENT INTEREST

The inventions described herein may be manufactured, used and licensed by or for the United States Government.

BACKGROUND OF THE INVENTION

The invention relates in general to munitions and in particular to limited range projectiles.

Firing ranges for firing weapons and training weapon users are often located in areas where stray projectiles may cause damage to people and property. Some firing and training ranges, for example, training ranges for soldiers and law enforcement personnel, often require more than a single firing direction. These types of ranges need very large safe areas called "range fans" for firing weapons in multiple directions and angles of elevation. Standard or non-limited range ammunition can be lethal at very long ranges and, therefore, requires the use of very large firing and training range areas. However, the availability of very large firing and training range areas is limited. Another problem with standard ammunition arises in certain close military combat areas or civilian police areas. In these areas, standard ammunition may cause unintended collateral damage when it misses its intended target and strikes a neutral or friendly target.

One known method of limiting the range of projectile ammunition is to attach fins to the rear end of the projectile or bullet. Another known method is to form geometric cuts in the forward end (nose) of a projectile to increase aerodynamic drag and induce aerodynamic instability down range. While the known limited range projectiles have reduced lethal range compared to standard unlimited range projectiles, further limits in lethal range are needed. For example, some .50 caliber limited range ammunition that relies on geometric nose cuts may have a range in excess of 3500 meters.

There is a long-felt but unsolved need for limited range, lethal ammunition that has a shorter range than known limited range, lethal ammunition.

SUMMARY OF INVENTION

One aspect of the invention is a projectile having a monolithic copper jacket with a forward end, a rear end, an interior, an ogive portion that includes the forward end, a base portion that includes the rear end, and a cylindrical portion disposed between the ogive portion and the base portion. Pyrotechnic initiating material is disposed in the interior of the jacket and extends from the rear end of the copper jacket forward into the interior. The pyrotechnic initiating material may extend at least into the cylindrical portion.

Reactive material is disposed in the interior of the jacket. The reactive material completely surrounds the pyrotechnic material in the interior and extends from the rear end of the copper jacket forward into the interior past a forward most point of the pyrotechnic initiating material and at least into the cylindrical portion. The entire radially outermost surface of the reactive material is contiguous with the inner surface of the copper jacket.

A penetrator is disposed in the jacket and abuts a forward end of the reactive material. The penetrator is made of a material with a hardness at least twice as great as the hardness of the copper jacket. The penetrator may include a protrusion on its rear end. The protrusion is inserted in a mating opening in the forward end of the reactive material. The rear end of the penetrator may make a press fit with the mating opening in the reactive material.

The projectile may be radially symmetric at all transverse cross-sections.

Another aspect of the invention is a projectile with an ogive portion, a cylindrical portion that abuts a rear of the ogive portion and that is discrete from the ogive portion, and a base portion that abuts a rear of the cylindrical portion and that is discrete from the cylindrical portion.

The ogive portion includes a solid penetrator that defines a forward end of the projectile and, abutting a rear of the solid penetrator and discrete from the solid penetrator, an ogive shell that defines a hollow interior. The cylindrical portion includes a shell and a hollow interior. The base portion includes a shell and a hollow interior.

Pyrotechnic initiating material is disposed in the hollow interior of the base portion and extends from a rear end of the projectile forward into the hollow interior of the cylindrical portion. Reactive material is disposed in each of the hollow interiors of the base portion, the cylindrical portion and the ogive portion. The reactive material completely surrounds at least a portion of the pyrotechnic initiating material and extends from the rear end of the projectile past a forward-most extent of the pyrotechnic initiating material. The entire radially outermost surface of the reactive material is contiguous with respective inner surfaces of the base portion shell, the cylindrical portion shell and the ogive portion shell. A forward end of the reactive material abuts the rear of the penetrator.

The hardness of the solid penetrator may be greater than respective hardnesses of the ogive portion shell, the cylindrical portion shell, and the base portion shell. The projectile may be radially symmetric at all transverse cross-sections.

The projectile may include a protrusion on a rear end of the solid penetrator that is inserted in a mating opening in the forward end of the reactive material.

The cylindrical portion shell may be torsionally fixed to the ogive portion shell and the base portion shell.

In one embodiment, the cylindrical portion shell may include one of mating tabs or mating slots, and the ogive portion shell and the base portion shell may each include the other of the mating tabs and the mating slots. The mating tabs and slots torsionally fix the cylindrical portion shell to the ogive portion shell and the base portion shell.

In another embodiment, the cylindrical portion shell includes one mating portion of a snap-fit joint, and the ogive portion shell and the base portion shell each include another mating portion of the snap-fit joint. The snap-fit joints torsionally fix the cylindrical portion shell to the ogive portion shell and the base portion shell.

Another aspect of the invention is a method that includes launching a projectile containing pyrotechnic initiating material and reactive material. During launching, the method includes igniting the pyrotechnic initiating material. Then, the reactive material is ignited using the pyrotechnic initiating material. Prior to any impact of the projectile with a target and while the projectile is airborne, the projectile is transformed into an aerodynamically unstable object, using energy from the reactive material.

Transforming the projectile into an aerodynamically unstable object may include rendering the projectile incapable of continued flight.

In one embodiment of the method, launching the projectile may include launching a projectile having a copper jacket, and transforming the projectile into an aerodynamically unstable object may include melting the copper jacket.

In another embodiment of the method, launching the projectile may include launching a projectile having discrete ogive, cylindrical and base portions with the cylindrical portion disposed between the ogive and the base portions, and transforming the projectile into an aerodynamically unstable object may include separating the cylindrical portion from the ogive and base portions.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

A limited range projectile includes pyrotechnic initiating material and reactive material. The pyrotechnic initiating material is ignited when the projectile is launched. The pyrotechnic initiating material ignites the reactive material. When the projectile reaches a desired maximum range, while in flight and before striking a target, the energy produced by the ignited reactive material renders the projectile aerodynamically unstable. The aerodynamically unstable projectile may be incapable of continued flight. The type, geometry, and amounts of the pyrotechnic initiating material and the reactive material, along with the construction of the projectile, may be varied to tailor the range at which the projectile is rendered aerodynamically unstable.

Figure 1:
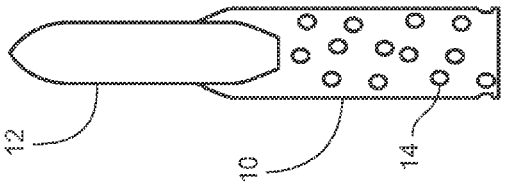
FIG. 1 is a schematic drawing of a limited range projectile in a cartridge case.

The projectile may be any caliber, for example, from 5.56 mm to 155 mm. As shown in FIG. 1, prior to launch from a tube, the limited range projectile 12 may be seated in a cartridge case 10 that contains propellant 14. Or, projectile 12 may be launched from a tube using bagged or loose propellant. The launching tube may be, for example, the barrel of a pistol, rifle, or shotgun, an artillery gun, a tank gun, a howitzer, or a mortar tube.

Figure 2:
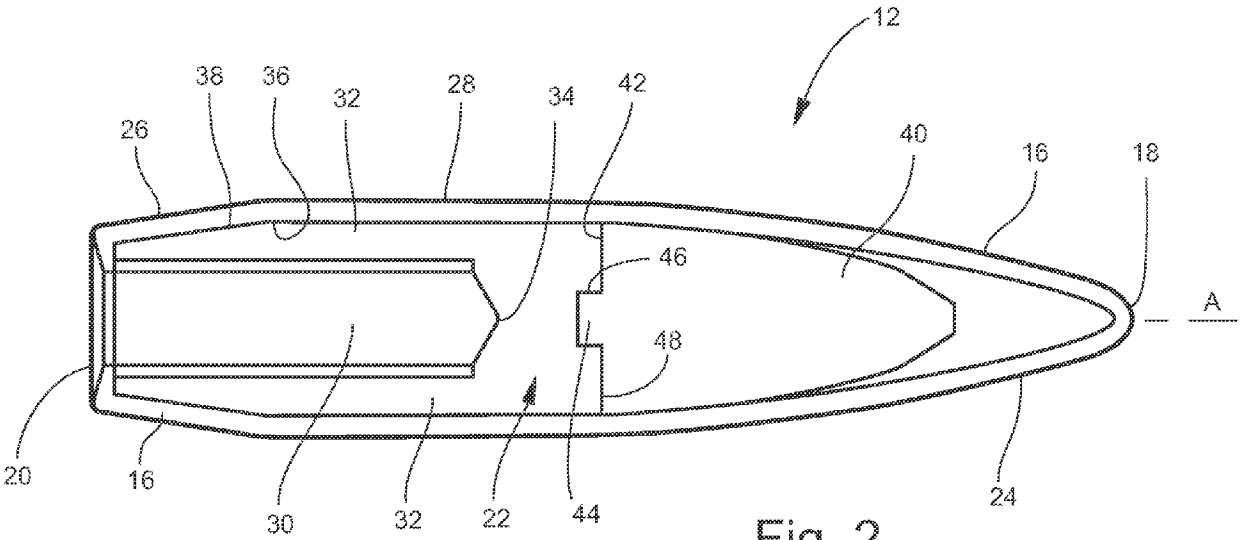
FIG. 2 is a side cutaway view of one embodiment of a limited range projectile.

Referring to FIG. 2, one embodiment of limited range projectile 12 includes a monolithic copper jacket 16 having a forward end 18, a rear end 20 and an interior 22. Copper jacket 16 includes an ogive portion 24 with forward end 18 and a base portion 26 with rear end 20. A cylindrical portion 28 of copper jacket 16 is disposed between ogive portion 24 and base portion 26. Pyrotechnic initiating material 30 is disposed in interior 22 and extends from rear end 20 of copper jacket 16 forward into interior 22. Pyrotechnic initiating material 30 extends at least into cylindrical portion 28. A small opening (not shown) may be formed in rear end 20 adjacent pyrotechnic material 30 to enable ignition of material 30. The opening may be covered with a membrane.

Reactive material 32 is disposed in interior 22 around pyrotechnic initiating material 30. As used herein, "reactive material" means the class of materials that generally combine two or more nonexplosive solids which, upon their ignition, react to release chemical energy. Examples of reactive materials include mixtures of: 1) aluminum and iron oxide; 2) tungsten, nickel, titanium and aluminum; and 3) hafnium and nickel. Reactive material 32 completely surrounds pyrotechnic initiating material 30 in interior 22. Reactive material 32 extends from rear end 20 forward into interior 22 past a forward-most point 34 of pyrotechnic initiating material 30. Reactive material 32 extends at least into cylindrical portion 28. The entire radially outermost surface 36 of reactive material 32 is contiguous with the inner surface 38 of copper jacket 16.

A penetrator 40 is disposed in jacket 16. Penetrator 40 abuts the forward end 42 of reactive material 32. Penetrator 40 is preferably made of a material with a hardness at least twice as great as the hardness of copper jacket 16. Penetrator 40 may be made of, for example, tungsten, tool steel, or 1045 cold rolled steel. Penetrator 40 may include a protrusion 44 on its rear end 48. Protrusion 44 is inserted, for example, with a press-fit, into a mating opening 46 in forward end 42 of reactive material 32.

Projectile 12 includes a central longitudinal axis A. Preferably, each transverse cross-section of projectile 12 is radially symmetric around axis A.

Figure 3:
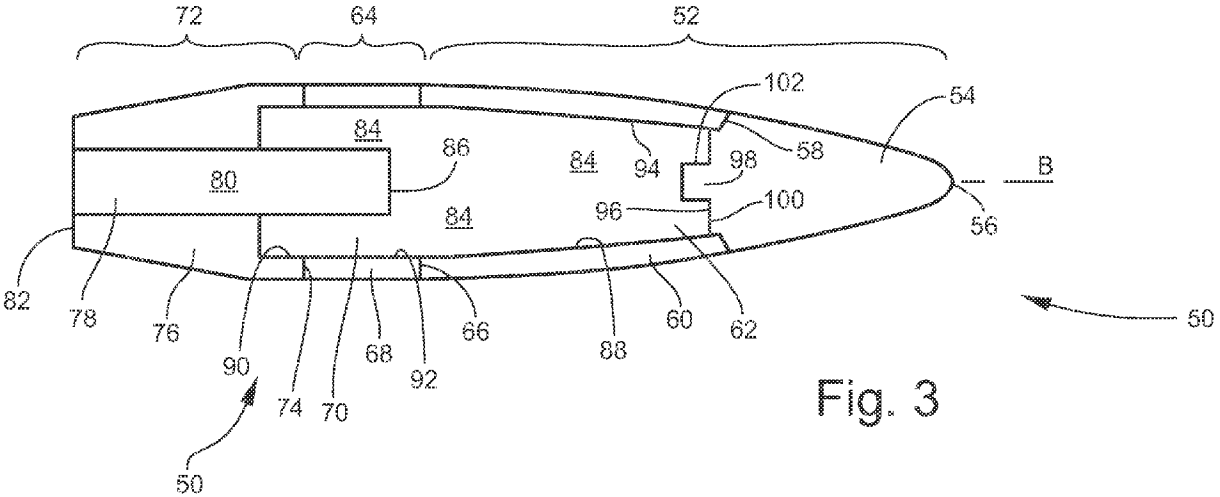
FIG. 3 is a side cutaway view of another embodiment of a limited range projectile.

FIG. 3 is a side cutaway view of another embodiment of a limited range projectile 50. Like projectile 12, projectile 50 may be seated in cartridge case 10 containing propellant 14 or may be launched from a tube using bagged or loose propellant. Projectile 50 includes an ogive portion 52, a cylindrical portion 64 and a base portion 72.

Ogive portion 52 includes a solid penetrator 54 that defines a forward end 56 of projectile 50. Ogive portion 52 includes an ogive shell 60 that abuts a rear 58 of solid penetrator 54 and is discrete from solid penetrator 54. Ogive shell 52 defines a hollow interior 62. Cylindrical portion 64 abuts a rear 66 of ogive portion 52 and is discrete from ogive portion 52. Cylindrical portion 64 includes a shell 68 and a hollow interior 70. Base portion 72 abuts a rear 74 of cylindrical portion 64 and is discrete from cylindrical portion 64. Base portion 72 includes a shell 76 and a hollow interior 78.

Pyrotechnic initiating material 80 is disposed in hollow interior 78 of base portion 72. Pyrotechnic initiating material 80 extends from a rear end 82 of projectile 50 forward into hollow interior 70 of cylindrical portion 64. A small opening (not shown) may be formed in rear end 82 adjacent pyrotechnic material 80 to enable ignition of material 80. The opening may be covered with a membrane.

Reactive material 84 is disposed in each of base portion hollow interior 78, cylindrical portion hollow interior 70 and ogive portion hollow interior 62. Reactive material 84 completely surrounds at least a portion of pyrotechnic initiating material 80. Reactive material 84 extends from rear end 82 of projectile 50 past a forward-most extent 86 of pyrotechnic initiating material 80. The entire radially outermost surface 88 of reactive material 84 is contiguous with respective inner surfaces 90, 92, 94 of base portion shell 76, cylindrical portion shell 68 and ogive portion shell 60. The forward end 96 of reactive material 84 abuts rear 100 of penetrator 54.

Preferably, the mechanical hardness of solid penetrator 54 is greater than respective hardnesses of ogive portion shell 60, cylindrical portion shell 68, and base portion shell 76. Penetrator 54 may be made of, for example, tungsten, tool steel, or 1045 cold rolled steel. Shells 60, 68, and 76 may be made of, for example, brass, gilding metal, aluminum, or soft alloy steel.

Projectile 50 includes a central longitudinal axis B. Preferably, each transverse cross-section of projectile 50 is radially symmetric around axis B. Solid penetrator 54 may include a protrusion 98 on its rear end 100. Protrusion 98 may be inserted in a mating opening 102 in forward end 96 of reactive material 84. Protrusion 98 may be, for example, press-fit in mating opening 102.

Figure 4:
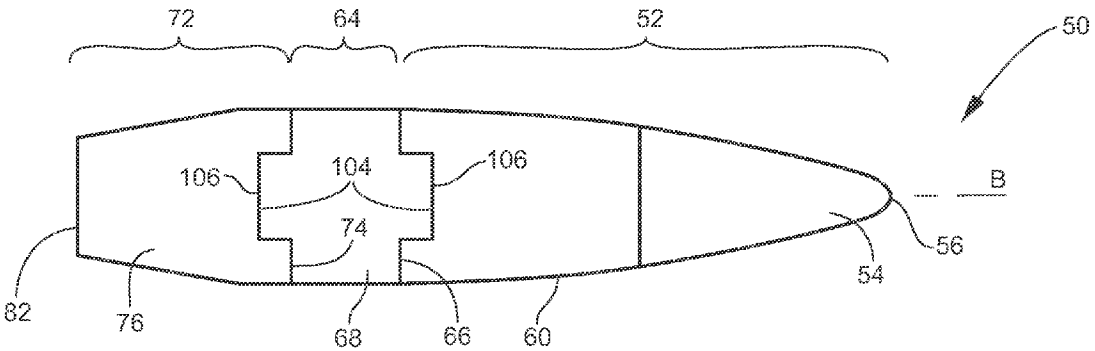
FIG. 4 is a side view of the projectile of FIG. 3.

Shell 68 of cylindrical portion 64 may be torsionally fixed to ogive portion shell 60 and base portion shell 76. In one embodiment, as shown in FIG. 4, cylindrical portion shell 68 includes one or more tabs 104. Tabs 104 may be disposed on opposing axial ends of cylindrical portion shell 68 and may be spaced apart circumferentially around cylindrical shell 68. Slots 106 that mate with tabs 104 may be formed in ogive portion shell 60 and base portion shell 76. Tabs 104 may be, for example, press-fit into slots 106. The location of tabs 104 and slots 106 may be reversed so that cylindrical portion shell 68 includes slots 106 and tabs 104 are formed on ogive portion shell 60 and base portion shell 76. Tabs 104 and slots 106 torsionally fix cylindrical portion shell 68 to ogive portion shell 60 and base portion shell 76.

Figure 5:
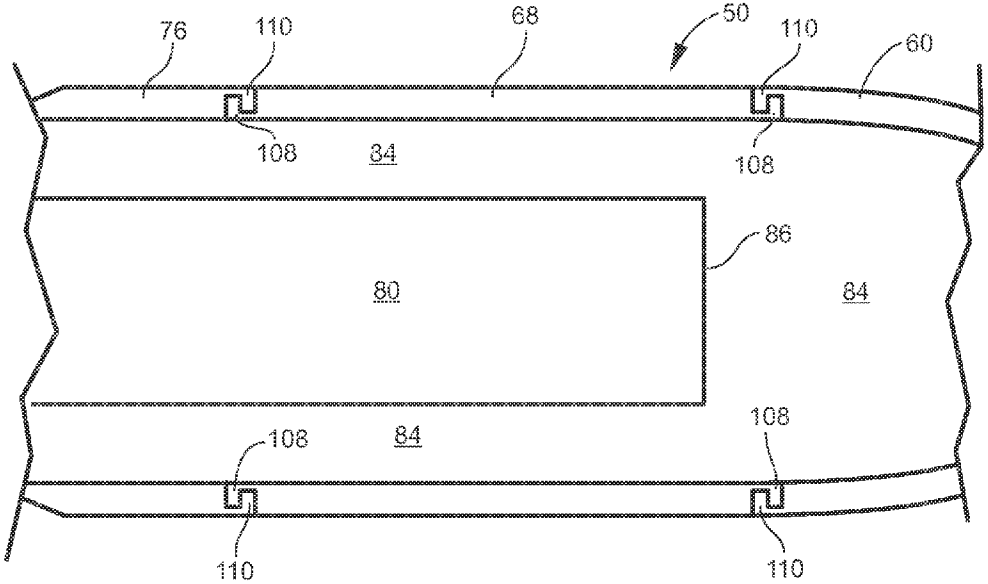
FIG. 5 is an enlarged cutaway view showing a variation of the projectile of FIG. 3.

As an alternative to tabs and slots, cylindrical portion shell 68 may include one mating portion 108 (FIG. 5) of a snap-fit joint, and each of ogive portion shell 60 and base portion shell 76 may include another mating portion 110 of the snap-fit joint. The snap-fit mating portions 108, 110 torsionally fix cylindrical portion shell 68 to ogive portion shell 60 and base portion shell 76.

During launching of projectile 12 or 50, pyrotechnic initiating material 30 or 80 is ignited by energy produced by propellant 14 in cartridge case 10. Or, pyrotechnic initiating material 30 or 80 may be ignited by energy produced by bagged propellant, if projectile 12 or 50 is a separately loaded projectile. Pyrotechnic initiating material 30 or 80 ignites reactive material 32 or 84. Prior to impact of projectile 12 or 50 with a target, and while projectile 12 or 50 is airborne, energy produced by the ignited reactive material 32 or 84 transforms projectile 12 or 50 into an aerodynamically unstable object. The transformation into an aerodynamically unstable object renders projectile 12 or 50 incapable of continued flight.

Figure 7:
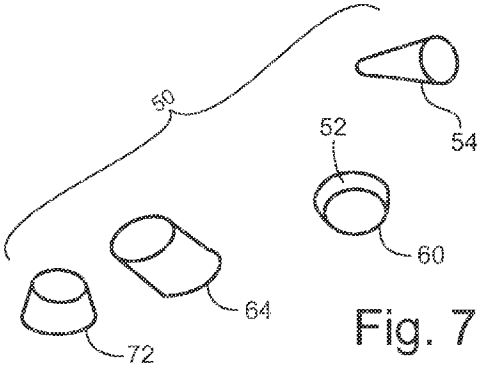
FIG. 7 is a side view of the projectile of FIG. 3 in an aerodynamically unstable state.
Figure 6:
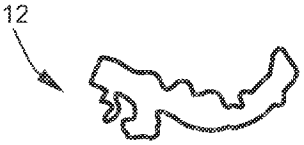
FIG. 6 is a side view of the projectile of FIG. 2 in an aerodynamically unstable state.

Projectile 12 is rendered unstable by the melting of copper jacket 16, which produces a highly irregular shape, as shown in FIG. 6. Projectile 50 is rendered unstable by the separation of cylindrical portion 64 from ogive and base portions 52, 72 and the separation of penetrator 54 from ogive shell 60, as shown in FIG. 7.

Computerized modeling and simulation were performed to compare the inventive projectiles to the .50 caliber M33 projectile and .50 caliber M8 projectile.

In interior ballistics modeling and simulation, the powder charge (propellant 14) for the inventive projectiles was varied to achieve a pressure v. time curve similar to the M8 in a 36 inch barrel. Theoretical muzzle velocities of the novel projectiles were similar to the M8. The inventive projectiles "survived" the gun launch and had plastic strain similar to the M8.

In exterior ballistics modeling and simulation, the novel projectiles demonstrated pre-destabilization trajectory comparable to the M33, with a maximum range less than 2000 meters.

In penetration modeling and simulation against 0.375 inch rolled homogeneous armor at 200 meters with an impact velocity of 2500 feet/second, the inventive projectiles demonstrated penetration capability comparable to the M8 projectile.

While the invention has been described with reference to certain embodiments, numerous changes, alterations and modifications to the described embodiments are possible without departing from the spirit and scope of the invention as defined in the appended claims, and equivalents thereof.

What is claimed is:

1. A projectile, comprising:

an ogive portion including a solid penetrator that defines a forward end of the projectile and, abutting a rear of the solid penetrator and discrete from the solid penetrator, an ogive shell that defines a hollow interior;

a cylindrical portion that abuts a rear of the ogive portion and is discrete from the ogive portion, the cylindrical portion including a shell and a hollow interior;

a base portion that abuts a rear of the cylindrical portion and is discrete from the cylindrical portion, the base portion including a shell and a hollow interior;

pyrotechnic initiating material disposed in the hollow interior of the base portion and extending from a rear end of the projectile forward into the hollow interior of the cylindrical portion;

reactive material disposed in each of the hollow interiors of the base portion, the cylindrical portion and the ogive portion, the reactive material completely surrounding at least a portion of the pyrotechnic initiating material and extending from the rear end of the projectile past a forward-most extent of the pyrotechnic initiating material, an entire radially outermost surface of the reactive material being contiguous with respective inner surfaces of the base portion shell, the cylindrical portion shell and the ogive portion shell, a forward end of the reactive material abutting the rear of the penetrator.

2. The projectile of claim 1, wherein a hardness of the solid penetrator is greater than respective hardnesses of the ogive portion shell, the cylindrical portion shell, and the base portion shell.

3. The projectile of claim 1, wherein the projectile is radially symmetric at all transverse cross-sections.

4. The projectile of claim 3, further comprising a protrusion on a rear end of the solid penetrator that is inserted in a mating opening in the forward end of the reactive material.

5. The projectile of claim 3, wherein the cylindrical portion shell is torsionally fixed to the ogive portion shell and the base portion shell.

6. The projectile of claim 5, wherein the cylindrical portion shell includes one of mating tabs and mating slots, and the ogive portion shell and the base portion shell each include the other of the mating tabs and the mating slots, for torsionally fixing the cylindrical portion shell to the ogive portion shell and the base portion shell.

7. The projectile of claim 5, wherein the cylindrical portion shell includes one mating portion of a snap-fit joint, and the ogive portion shell and the base portion shell each include another mating portion of the snap-fit joint, for torsionally fixing the cylindrical portion shell to the ogive portion shell and the base portion shell.

8. A method, comprising:

launching a projectile containing pyrotechnic initiating material and reactive material;

during launching, igniting the pyrotechnic initiating material; then igniting the reactive material using the pyrotechnic initiating material; then prior to any impact of the projectile with a target and while the projectile is airborne, transforming the projectile into an aerodynamically unstable object using energy from the reactive material.

9. The method of claim 8, wherein transforming the projectile into an aerodynamically unstable object includes rendering the projectile incapable of continued flight.

10. The method of claim 8, wherein launching a projectile includes launching a projectile having a copper jacket and wherein transforming the projectile info an aerodynamically unstable object includes melting the copper jacket.

11. The method of claim 8, wherein launching a projectile includes launching a projectile having discrete ogive, cylindrical and base portions with the cylindrical portion disposed between the ogive and the base portions, and wherein transforming the projectile into an aerodynamically unstable object includes separating the cylindrical portion from the ogive and base portions.

12. The method of claim 8, further comprising, before launching the projectile, providing a cartridge case with propellant disposed therein and wherein the projectile is disposed in the cartridge case.

13. The method of claim 12, wherein the pyrotechnic initiating material is ignited by the propellant in the cartridge case.

* * * * *